US009627786B2

(12) United States Patent
Hsu

(10) Patent No.: US 9,627,786 B2
(45) Date of Patent: Apr. 18, 2017

(54) ELECTRICAL CONNECTOR WITH IMPROVED CONTACTS

(71) Applicant: FOXCONN INTERCONNECT TECHNOLOGY LIMITED, Grand Cayman (KY)

(72) Inventor: Shuo-Hsiu Hsu, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 38 days.

(21) Appl. No.: 14/695,064

(22) Filed: Apr. 24, 2015

(65) Prior Publication Data

US 2015/0311626 A1 Oct. 29, 2015

(30) Foreign Application Priority Data

Apr. 25, 2014 (TW) ..... 103207259 U

(51) Int. Cl.

| | |
|---|---|
| ***H01R 13/62*** | (2006.01) |
| ***H01R 12/71*** | (2011.01) |
| ***H01R 12/70*** | (2011.01) |
| ***H01R 13/627*** | (2006.01) |

(52) U.S. Cl.

CPC ..... *H01R 12/716* (2013.01); *H01R 12/7076* (2013.01); *H01R 13/627* (2013.01)

(58) Field of Classification Search

CPC .... H01R 13/62; H01R 13/635; H01R 13/633; H01R 12/716; G06K 13/08

USPC ..... 439/155, 159

See application file for complete search history.

(56) References Cited

U.S. PATENT DOCUMENTS

| | | | | |
|---|---|---|---|---|
| 6,093,039 A * | 7/2000 | Lord | G06F 1/1632 361/679.41 |
| 6,406,309 B1 * | 6/2002 | Ennis | H01R 13/6335 439/152 |
| 6,955,549 B2 * | 10/2005 | Brazell | B25F 5/02 439/155 |

* cited by examiner

*Primary Examiner* — Khiem Nguyen

(74) *Attorney, Agent, or Firm* — Wei Te Chung; Ming Chieh Chang

(57) ABSTRACT

An electrical connector, adapted for being mounted with an accessory, comprises a body and a frame surrounding the body, the body has a base and a plurality of blocking walls extending upwardly from the base. The base and the blocking wall define a receiving cavity for receiving the accessory, the blocking wall has a locking arm extending into the receiving cavity to retain the accessory, and the frame has a pushing arm for upwardly pushing the accessory out of the receiving cavity. The electrical connector retain the accessory in the receiving cavity by the locking arm, and push the accessory out off by the pushing arm when the locking arm is released, it is simply to operation.

18 Claims, 6 Drawing Sheets

ELECTRICAL CONNECTOR WITH IMPROVED CONTACTS

BACKGROUND OF THE INVENTION

1. Field of the Invention

The present invention relates to electrical connectors, more particularly to an electrical connector being mounted with an accessory element.

2. Description of Related Art

Electrical connectors are widely used in electronic equipments, such as computers. An electrical connector for connecting a module with a printed circuit board or connecting two modules usually has a body with a space for receiving the module. However, following the miniaturization trend of the electronic equipments, the module and the electrical connector are designed to be more and more smaller, sometime the electrical connector even needs to contain some other mini accessories therein, then it becomes a difficult thing to pick the mini accessories from the electrical connector.

An improved electrical connector is desired.

BRIEF SUMMARY OF THE INVENTION

According to one aspect of the present invention, an electrical connector, adapted for receiving an accessory, comprises a body, a locking arm and a frame. The body has a seat with a receiving space, and the locking arm extends from a peripheral of the seat toward the receiving space for retaining the accessory received in the receiving space. The locking arm is able to deflect outwardly for releasing the accessory. The frame surrounds the body, and has an elastic pushing arm which extends into the receiving space from a bottom side for upwardly pushing the accessory.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
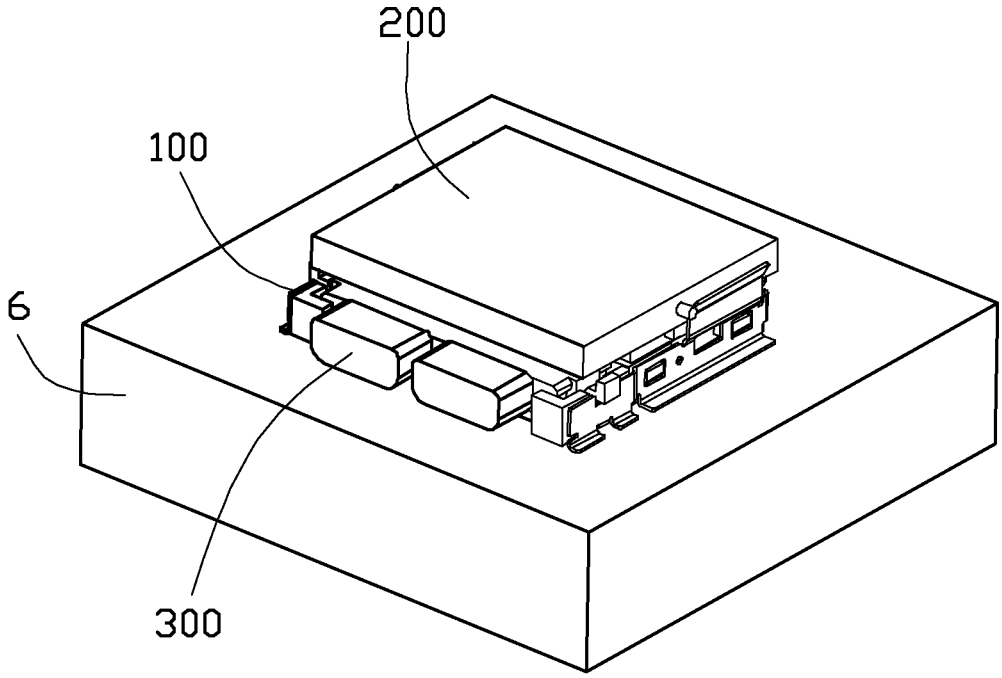
FIG. 1 is an assembled, perspective view of an electrical connector according to the present invention and being mounted on a printed circuit board, wherein an electronic component and an accessory are received in the electrical connector.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Figure 2:
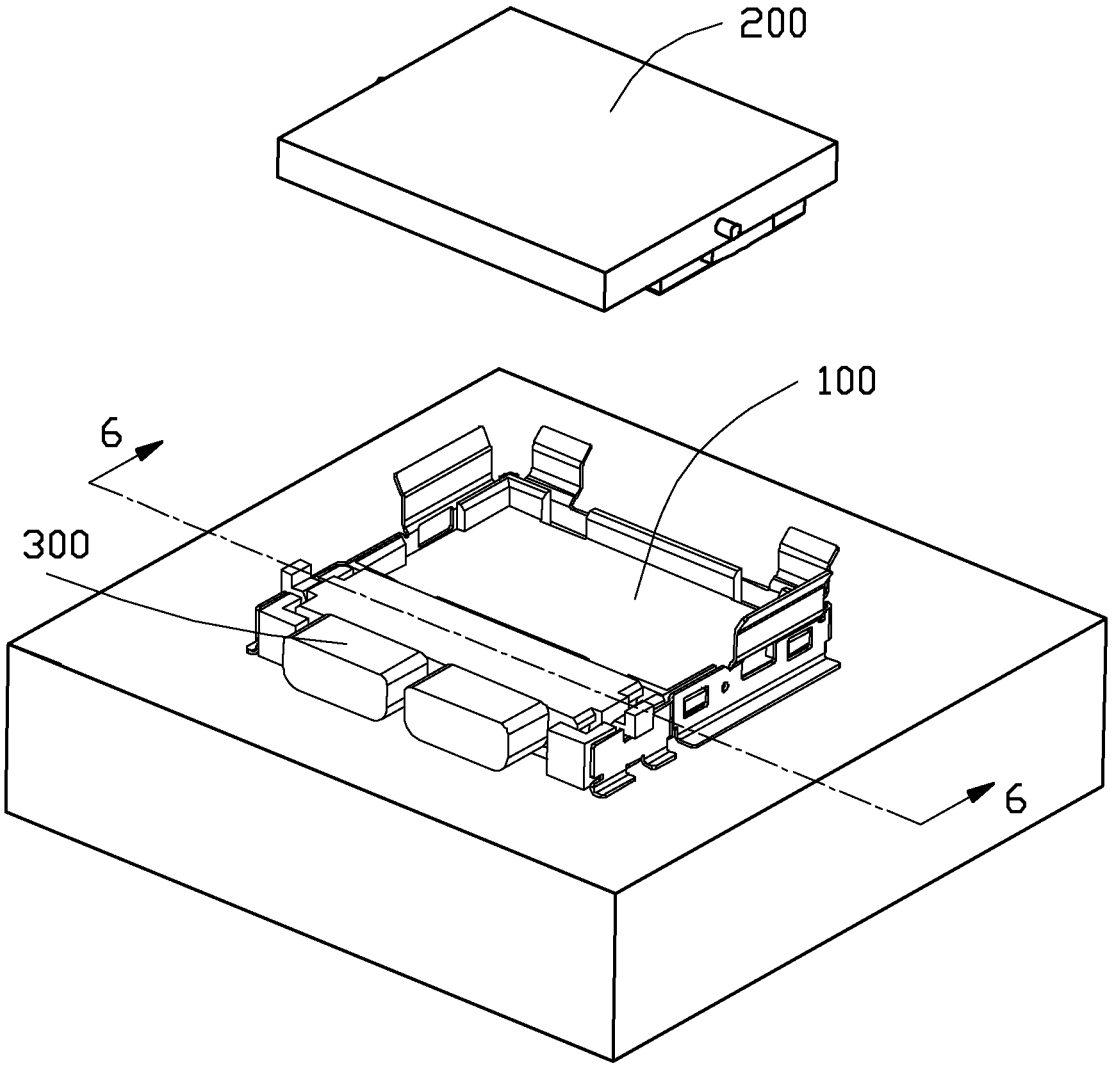
FIG. 2 is another assembled, perspective view of the electrical connector mounted on the printed circuit board, wherein the electronic component is taken out from the electrical connector.
Figure 3:
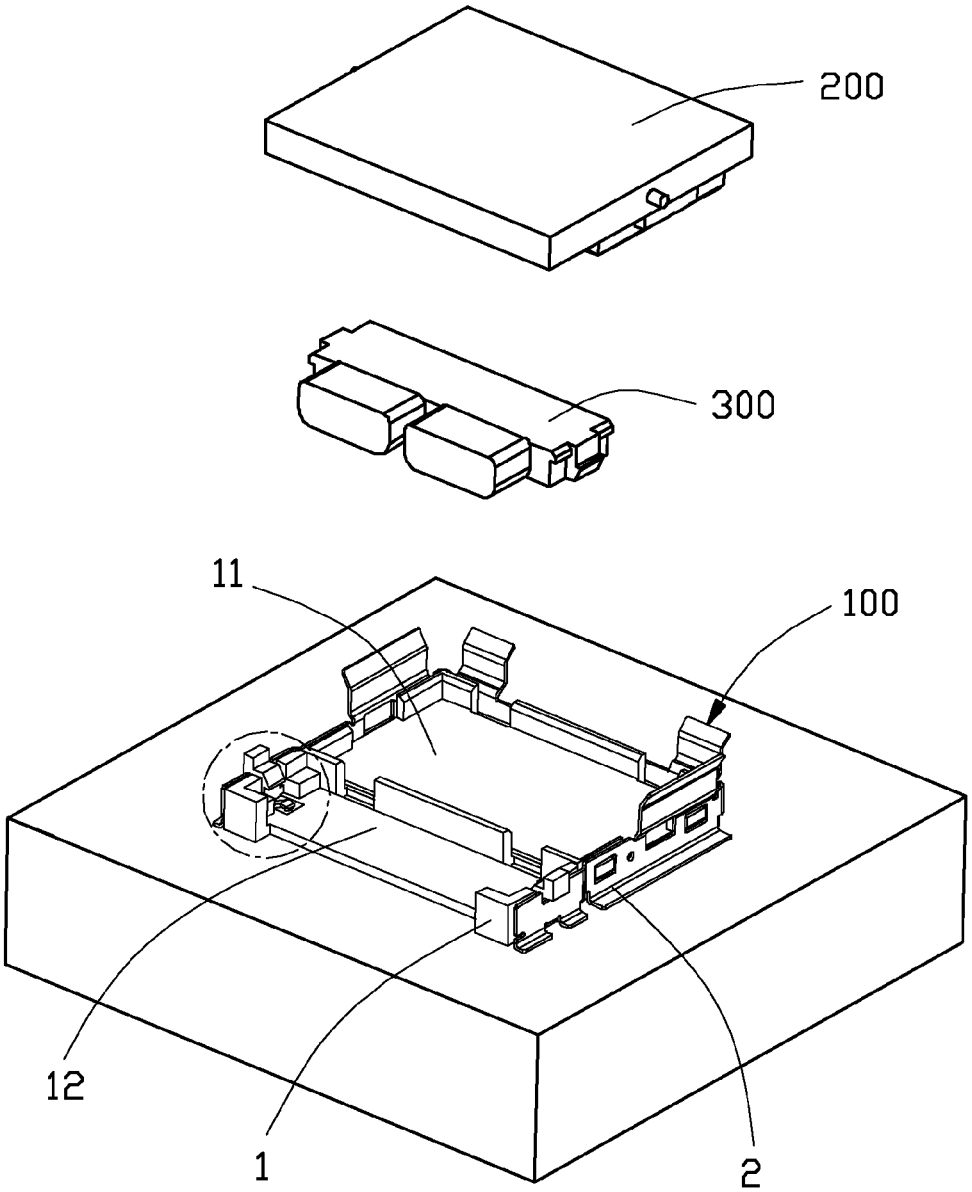
FIG. 3 is similar with FIG. 2, and wherein the accessory is further removed from the electronic component.

Referring to FIGS. 1-3, the electrical connector 100 in accordance with present invention, adapted for electrically connecting an electronic component 200 on printed circuit board 6, receiving an accessory 300. The electrical connector 100 has a body or housing 1 and a frame 2 surrounding the body 1, and the body 1 has a socket 11 for receiving the electronic component 200 and a seat 12 for receiving the accessory 300.

Figure 4:
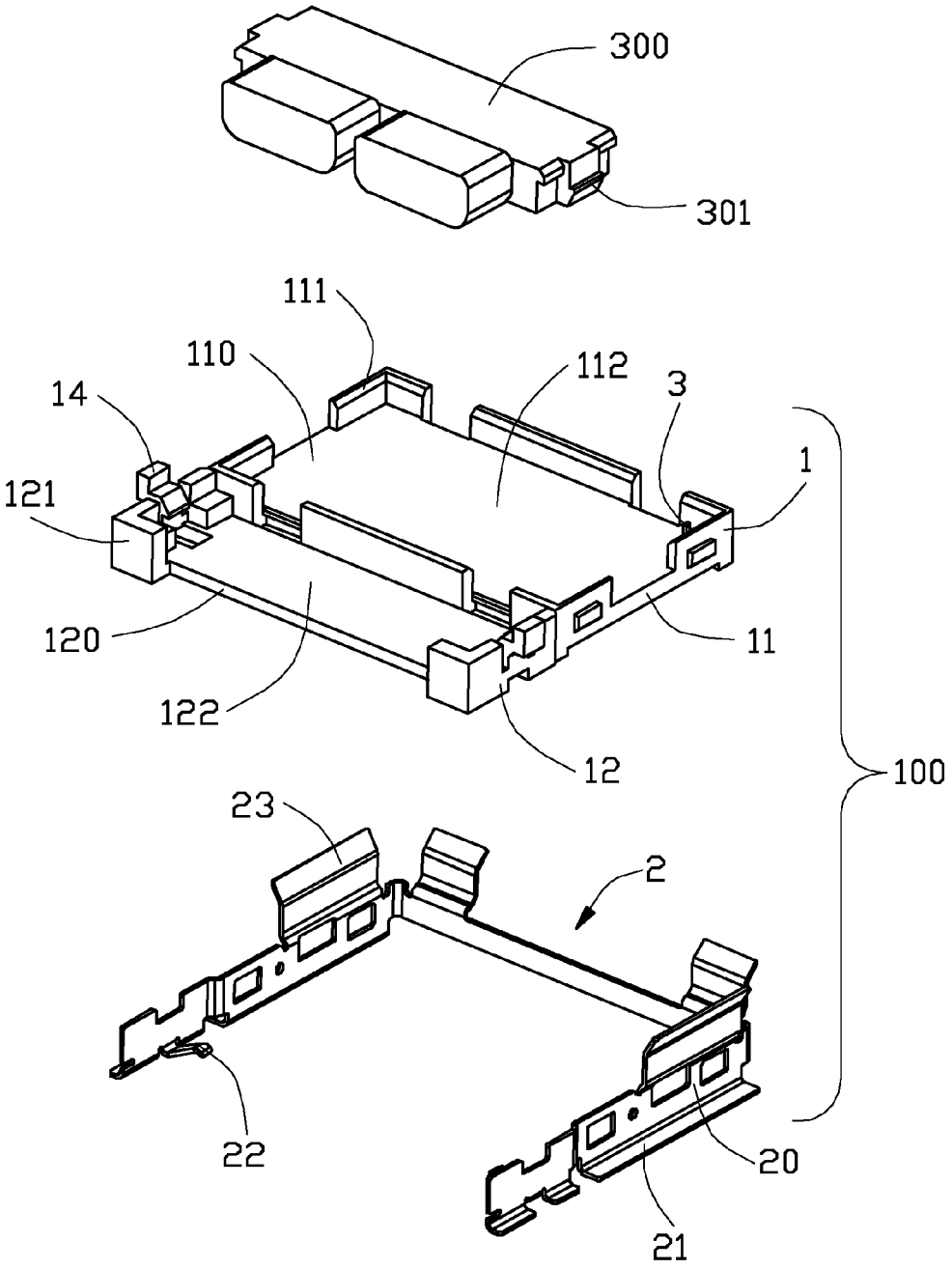
FIG. 4 is an explored, perspective view of the electrical connector and the accessory in FIG. 3.
Figure 5:
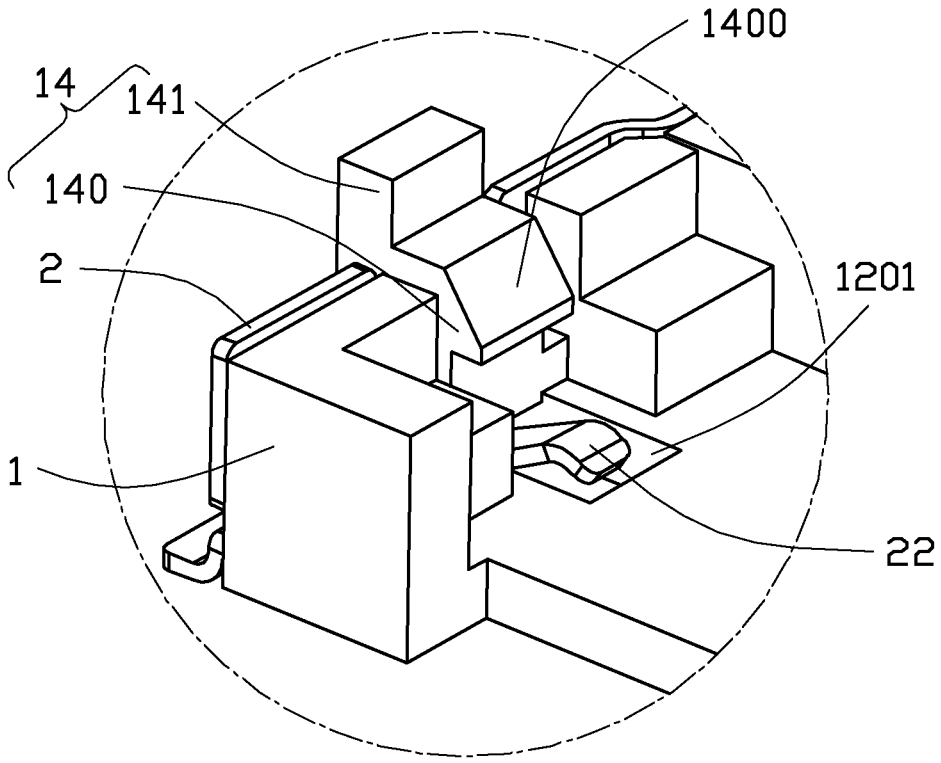
FIG. 5 is an enlarged view of the circuited part in FIG. 3.

Referring to FIG. 4 and FIG. 5, the socket 11 has a bottom wall 110, a plurality of sidewalls 111 extending from a peripheral of the bottom wall 110 and a plurality of contacts 3 disposed on the bottom wall 110, only one is shown in FIG. 4 here for reference. The bottom wall 110 and the sidewalls 111 cooperatively define a receiving cavity 112 for receiving the electronic component 200. The contact 3 expands into the receiving cavity 112 to electrically connect with the electronic component 200. In present embodiment, the electronic component 200 is a photoelectric modular, which can transmit signals with both the contacts 3 and the accessory 300.

The seat 12 is set beside the socket 11, and is integrated with the socket 11 in present invention, in face the seat 12 and the socket 11 also can be disposed separately. The seat 12 has a base 120 and a plurality of blocking walls 121 extending upwardly from the base 120, the base 120 and the blocking wall 121 together define a receiving space 122 for receiving the accessory 300 spaced from the receiving cavity 112 in a front-to-back direction. The receiving space 122 and the receiving cavity 112 are separated by the sidewall 111, the receiving space 122 has a small dimension other than the receiving cavity 112, the receiving space 122 has an opening opposite to the receiving cavity 112, through which the accessory 300 extends out the electrical connector 100 for connecting with other component outside the electrical connector 100.

The base 120 of the seat 12 has a pair of recesses 1201 passing through the base 120 along a top to bottom direction near the blocking walls 121. Two opposite of the blocking walls 121 of the seat 12 are opposite to each other in a transverse direction, and each of the blocking walls forms a locking arm 14, correspondingly to the recess 1201, the locking arm 14 has a latching portion 140 extending into the receiving space 122 and an operation portion 141 connecting with the latching portion 140 and located outside the latching portion 140. The operation portion 141 brings the latching portion 140 to deflect outwardly when being pressed. The latching portion 140 has an inclined guiding surface 1400 for guiding the accessory 300 into the receiving space 122.

The frame 2 is a metallic piece, and has a U-shaped configuration with a mouth. The frame 2 has a main case 20, a plurality of supporting legs 21 extending from a bottom of the main case 20 and a plurality of latching or retaining pieces 23 extending from a top of the main case 20 and used for latching with the electronic component 200 or easily assembling with the body 1. The frame 2 further has a pair of pushing or pressing arms 22 extending from the bottom of the main base 20 and aslant upwardly and inwardly, corresponding to the positions of the recesses 1201 of the seat 12 for deflection in a vertical direction.

Figure 6:
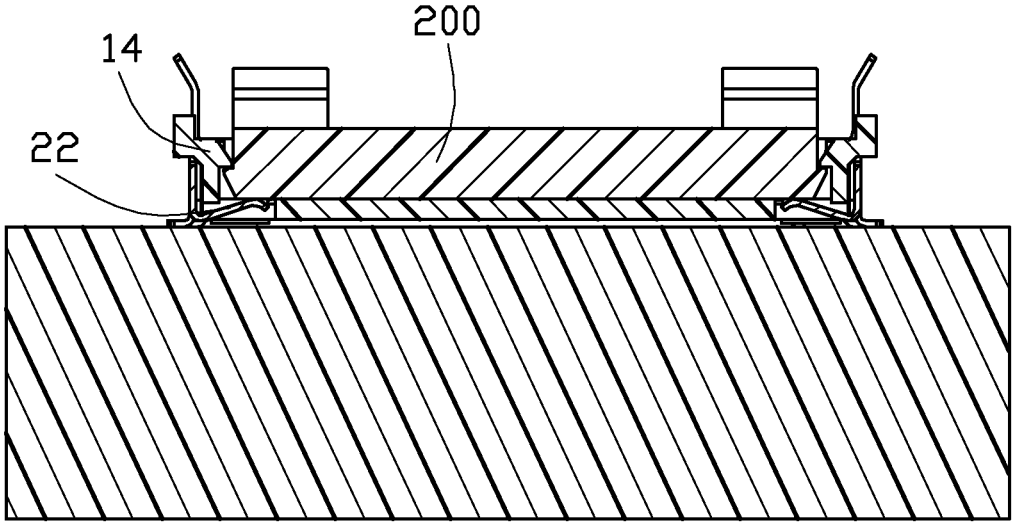
FIG. 6 is a sectional view of the electrical connector, the printed circuit board, the electronic component and the accessory taken from line 6-6 in FIG. 2.

Referring to FIG. 1 and FIG. 6, when the electrical connector 100 is assembled, the frame 2 is put out side the body 1, the main case 20 surrounds the sidewalls 111 and the blocking walls 121, the mouth of the is aligned with the opening of the receiving space 122. The pushing arms 22 pass through the recesses 1201 of the base 120 of the seat 12, and are located under corresponding latching arm 14.

The guiding face 1400 of the latching arm 14 guides the accessory 300 into the receiving space 122 of the seat 12 from a top side. Then, the accessory 300 downwardly pushes the pressing arm 22, and a step 301 formed on an outside face of the accessory 300 is latched by the latching portion 140 of the latching arm 14. When remove the accessory 300, outwardly push the operation portion 141 to bring the latching portion 140 deflect outwardly, then the pressing arm 22 restores and upwardly pushes the accessory 300 from the receiving space 133, and then the operator can easily pick up the accessory 300.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. An electrical connector, adapted for receiving an accessory, comprising a body, the body having a seat with a receiving space;

a locking arm extending from a peripheral of the seat toward the receiving space for retaining the accessory received in the receiving space, and the locking arm being able to deflect outwardly for releasing the accessory; and a frame, the frame surrounding the body and having an elastic pushing arm which extends into the receiving space from a bottom side for upwardly pushing the accessory;

wherein the frame is a U-shaped metallic frame, and the pushing arm integrally extends upwardly and inwardly from a bottom edge of the frame.

2. The electrical connector as claimed in claim 1, wherein the seat has a base and a plurality of blocking walls extending upwardly from the base, the base and the blocking wall together define the receiving space, two opposite of the blocking walls each are formed with the locking arm, and the frame is formed with two corresponding pushing arm.

3. The electrical connector as claimed in claim 2, wherein the seat defines two recesses under the receiving space to receive the pushing arms.

4. The electrical connector as claimed in claim 1, wherein the locking arm has a latching portion extending into the receiving space and an operation portion connecting with the latching portion and located outside the latching portion, the accessory has a step formed on an outside face thereof and is latched by the latching portion, the operation portion brings the latching portion to deflect outwardly when being pressed.

5. The electrical connector as claimed in claim 1, wherein the body has a socket for receiving an electronic component, and the seat is beside the socket and is integrated with the socket.

6. The electrical connector as claimed in claim 5, wherein the frame has a main case, a plurality of supporting legs extending from a bottom edge of the main case and a plurality of latching pieces extending from a top of the main case and used for latching with the electronic component.

7. An electrical connector comprises:

a socket, the socket defining a bottom wall, a plurality of sidewalls extending from a peripheral of the bottom wall and a plurality of contacts disposed on the bottom wall, the bottom wall and the sidewalls cooperatively defining a receiving cavity for receiving an electronic component, a seat integrated with the socket, and the seat having a base and a plurality of blocking walls extending upwardly from the base, the base and the blocking walls together defining a receiving space for receiving the accessory; and a frame surrounding the socket and the seat, the frame having an elastic pushing arm disposed under the receiving space and extending into the receiving space for upwardly pushing the accessory;

wherein the frame is a U-shaped metallic frame, and the pushing arm integrally extends upwardly and inwardly from a bottom edge of the frame.

8. The electrical connector assembly as claimed in claim 7, further comprising a locking arm extending from a peripheral of the seat toward the receiving space for retaining the accessory received in the receiving space, and the locking arms is able to deflect outwardly for releasing the accessory.

9. The electrical connector as claimed in claim 8, wherein two opposite of the blocking walls each are formed with the locking arm, and the frame is formed with two corresponding said pushing arm.

10. The electrical connector assembly as claimed in claim 9, wherein each of the locking arm has a latching portion extending into the receiving space and an operation portion connecting with the latching portion and located outside the latching portion, the accessory has a step formed on an outside face thereof and is latched by the latching portion, the operation portion brings the latching portion to deflect outwardly when being pressed.

11. The electrical connector as claimed in claim 8, wherein the seat defines a recess under the receiving space to receive the pushing arm.

12. The electrical connector as claimed in claim 1, wherein the frame has a main case, a plurality of supporting legs extending from a bottom edge of the main case and a plurality of latching pieces extending from a top of the main case and used for latching with the electronic component.

13. An electrical connector assembly comprising:

an insulative housing defining a receiving space and a receiving cavity spaced from each other along a first direction;

a metallic frame attached to a periphery of the housing;

a pair of resilient locking arms located by two sides of the receiving space in a second direction perpendicular to said first direction, each of said resilient locking arms being deflectable in said second direction;

a pair of pushing arms formed on the frame and extending inwardly to be located under the corresponding locking arms in a third direction perpendicular to both said first direction and said second direction, each of said pushing arms being deflectable in the third direction to set forth a restoration force;

an accessory received within the receiving space, deflecting the pushing arms and locked by said pair of locking arms in the third direction;

an electronic component receiving with the receiving cavity with portions extending in the first direction to be located right above the accessory in the third direction.

14. The electrical connector assembly as claimed in claim 13, wherein the pair of locking arms are integrally formed on the housing.

15. The electrical connector assembly as claimed in claim 14, wherein said frame forms corresponding space beside the corresponding pair of locking arms to allow outward deflection of the corresponding locking arms.

16. The electrical connector assembly as claimed in claim 13, wherein said pair of locking arms and said pair of pushing arms are aligned with each other in the third direction, respectively.

17. The electrical connector assembly as claimed in claim 13, wherein the housing is configured to leave an opening to allow the accessory to extend therethrough to protrude out of the housing in the first direction.

18. The electrical connector assembly as claimed in claim 13, wherein said frame further includes a plurality of retaining arms extending above an upper edge of the frame and an upper edge of the housing in the third direction.

* * * * *